United States Patent [19]

Siders, Jr.

[11] 4,138,116

[45] Feb. 6, 1979

[54] PUZZLE ASSEMBLY

[76] Inventor: Worthy G. Siders, Jr., 4305 Garrett Park Rd., Silver Spring, Md. 20906

[21] Appl. No.: 849,716

[22] Filed: Nov. 8, 1977

[51] Int. Cl.[2] ..... A63F 9/10

[52] U.S. Cl. ..... 273/157 R

[58] Field of Search ..... 273/157 R; 35/72

[56] References Cited

U.S. PATENT DOCUMENTS

| | | | |
|---|---|---|---|
| 1,165,980 | 12/1915 | Kortz | 273/157 R |
| 1,261,710 | 4/1918 | Coyle | 273/157 R |
| 1,265,300 | 5/1918 | Carlow | 273/157 R |
| 3,238,645 | 3/1966 | Wilson | 35/72 |

*Primary Examiner*—Anton O. Oechsle

*Attorney, Agent, or Firm*—Strauch, Nolan, Neale, Nies & Kurz

[57] ABSTRACT

A puzzle solved as a perfect square consisting of sixteen congruent, isosceles right triangles, 8 of which have their rignt-angle apices rounded, the remaining 8 having both of their acute angled corners rounded. The task is to solve the puzzle so that the periphery of the square is uninterrupted by any round corners.

2 Claims, 3 Drawing Figures

PUZZLE ASSEMBLY

BACKGROUND OF THE INVENTION

Deceptively simple puzzles comprising a number of variously sized squares, triangles or other polygons and adapted to be arranged into a predetermined pattern according to instructions are well known in the art. A selective sampling of such prior art puzzles reveals several variations on this general theme. For example, the purpose of the puzzle may be educational or purely recreational. Colors, designs or other indicia printed upon the puzzle pieces may be related to the eventual solving of the puzzle. The shapes of the several puzzle pieces may be identical, similar or varied.

Representative examples of the foregoing concepts are more specifically disclosed in the following prior art patents discussed in chronological order. U.S. Pat. No. 239,879 issued to W. Stranders discloses a number of square game cards having indicia printed thereon in triangular sectors whereby a number of cards are thereafter overlapped to produce a desired visual effect. A puzzle comprising a group of 4 non-congruent triangular pieces assembled as a square and further having colored surfaces and other indicia thereon is illustrated in U.S. Pat. No. 587,112 issued to J. S. Alston; U.S. Pat. No. 1,533,507 issued to N. J. May is very similar to the Alston patent. A related puzzle including five polygons wherein the puzzle may be solved either as a square or an equilateral triangle is shown in U.S. Pat. No. 1,271,997 issued to W. L. Benedict. Other puzzles including numbers of groups of regular polygons arranged in differing geometric designs are disclosed in U.S. Pat. No's. 1,273,089 issued to M. L. Ogle and 3,637,217 issued to S. Kent. Other disclosures of game puzzles including a series of polygons further having printed indicia are found in U.S. Pat. No's. 3,687,455 issued to M. Odier and 3,923,307 issued to V. J. Sukys et al.

However, the prior art fails to disclose a puzzle assembly solved as a smooth sided square comprised of a set of triangles having some rounded and some sharp corners whereby but a single solution is possible.

SUMMARY OF THE INVENTION

Accordingly, it is a primary object of the invention to provide a deceptively simple puzzle assembly solved as a square from a predetermined number of congruent triangles having rounded edges or corners according to a preset arrangement whereby only a single puzzle solution is possible.

It is another object of the invention to provide a puzzle assembly of a number of triangles solved as a square wherein the pieces may be inexpensively manufactured from a number of materials - plastic, cardboard, etc.

It is a further object of the invention to provide a puzzle assembly in the form of a square solved from a predetermined number of congruent triangles wherein considerable mental skill is required to solve what appears to be a deceptively simple puzzle.

In summary then, the invention is sixteen congruent, isosceles right triangles, half of which have rounded apices at their right-angle corners and half having their acute, 45° angle corners rounded. The puzzle is solved by forming a perfectly smooth sided square having no rounded corners. Accordingly, but one solution is possible. I prefer to call the invention "Corners and Elbows."

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1:
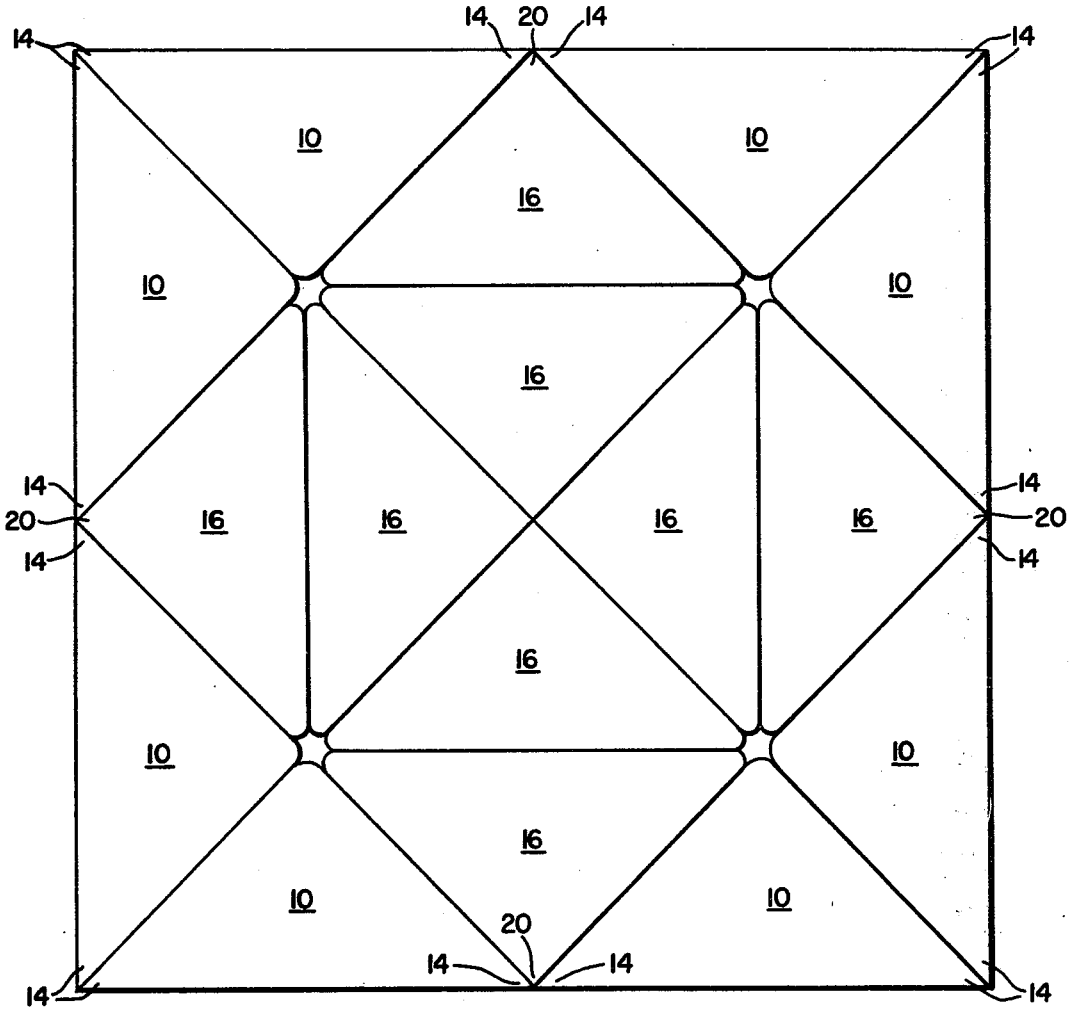
FIG. 1 is a plan view of the puzzle invention, solved correctly as a square.
Figure 2:
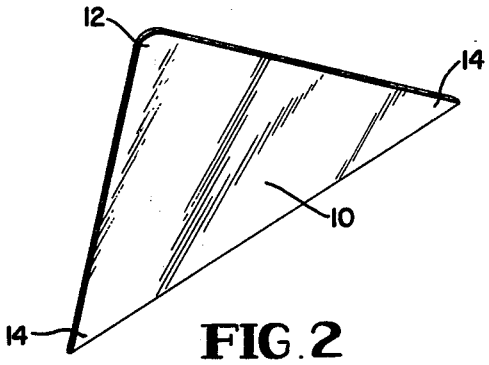
FIG. 2 is a perspective view of a representative one of half of the puzzle pieces.

The invention is designed to be solved as a perfect square having perfectly smooth side edges as is illustrated in FIG. 1. The square solution is made up of sixteen congruent isosceles right triangles, eight of which, referred to by reference numeral 10, have their right angle apices 12 rounded into "elbows" as it were, and as is shown in FIG. 2. However, the acute angle, 45° corners 14 of triangles 10 remain relatively sharply pointed, again as is easily seen in FIG. 2.

Figure 3:
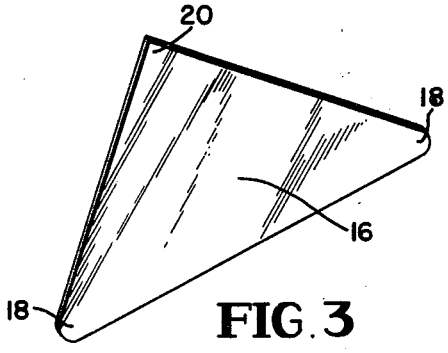
FIG. 3 is a perspective view of a representative one of the remaining half of the puzzle pieces.

Conversely, the remaining eight pieces 16 have their right angle corners 18 rounded into "elbows" as is shown in FIG. 3 while their right-angle apices 20 remain rather sharply defined as "corners". Thus, the eight apices 12 and the sixteen apices 18 comprise the "elbows" of the puzzle while the sharply defined or pointed corners 14 (being sixteen in number) and 20 (being eight in number) comprise the "corners" of the invention.

The solution of the puzzle assembly is defined as a perfect square having perfectly smooth side edges uninterruped by rounded corners, such as "elbows" 12 and 18. Since only pieces 10 have two "corners" 14, they will have to be assembled as the periphery of the square as is shown in FIG. 1. Since each side must be smooth, a "corner" 20 must be fitted between adjacent, touching "corners" 14 of the puzzle assembly. The assemblage of parts thus far explained will require the utilization of all of the pieces 10 and half of the pieces 16. This leaves four pieces 16 which are assembled as a central square in the puzzle assembly, as shown in FIG. 1, to thus solve the puzzle as instructed.

The individual pieces may be made of cardboard, plastic, perhaps, metal or any other appropriate material. Manufacture is both uncomplicated and inexpensive, as but eight in number of two differing pieces 10 and 16 are required to make the completed puzzle assembly.

After solution, the puzzle seems to be a very easy one indeed. It is further noted from FIG. 1 that all the rounded "elbows" are adjacently clustered into four distinct groups in solving the puzzle. In a preferred embodiment, each piece has a hypotenuse of 3 inches; thus, the solved square will have an edge dimension of 6 inches.

The puzzle assembly may be played as a game in solitary fashion or two or more players might try to solve it.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A puzzle assembly solved as a planar square consisting of sixteen congruent isosceles right triangular pieces, each of said pieces having a predetermined number of corners which are rounded in a predetermined, patterned manner with the remaining corners being sharp whereby the solved puzzle is a square having perfectly smooth, uninterrupted side edges and sharp corners.

2. The puzzle assembly claimed in claim 1, wherein the right-angle corners of half of said triangular pieces are rounded and the acute angled corners of each of the remaining half of said triangular pieces are rounded.

* * * * *